US007243807B2

(12) United States Patent
Lin

(10) Patent No.: US 7,243,807 B2
(45) Date of Patent: Jul. 17, 2007

(54) FLUID-TIGHT DILUTION BOTTLE AND CAP

(75) Inventor: Steve Lin, Tustin, CA (US)

(73) Assignee: PML Microbiologicals, Inc., Wilsonville, OR (US)

( * ) Notice: Subject to any disclaimer, the term of this patent is extended or adjusted under 35 U.S.C. 154(b) by 538 days.

(21) Appl. No.: 10/645,226

(22) Filed: Aug. 21, 2003

(65) Prior Publication Data

US 2005/0040131 A1 Feb. 24, 2005

(51) Int. Cl.
*B65D 41/34* (2006.01)
*B65D 51/04* (2006.01)

(52) U.S. Cl. ..... 215/235; 215/330; 215/214; 215/254; 222/556

(58) Field of Classification Search ..... 215/235, 215/254, 256, 214, 237, 320, 329, 330, 344, 215/354; 222/556
See application file for complete search history.

(56) References Cited

U.S. PATENT DOCUMENTS 3,235,117 A * 2/1966 Mason, Jr. ..... 215/256
3,817,416 A * 6/1974 Costa ..... 215/213
3,869,057 A * 3/1975 Miller ..... 215/216
3,871,545 A 3/1975 Béréziat
3,877,598 A * 4/1975 Hazard ..... 215/224
3,927,784 A * 12/1975 Cochrane ..... 215/256
3,991,904 A * 11/1976 Davis et al. ..... 215/256
3,994,409 A * 11/1976 Nightengale, Jr. ..... 215/256
4,127,221 A * 11/1978 Vere ..... 222/153.02
4,131,212 A * 12/1978 Rumball ..... 512/252
4,378,073 A * 3/1983 Luker ..... 215/237
4,487,324 A * 12/1984 Ostrowsky ..... 215/253
4,533,058 A * 8/1985 Uhlig ..... 215/216
4,557,393 A * 12/1985 Boik ..... 215/253
4,709,823 A 12/1987 Beck et al.
4,711,363 A * 12/1987 Marino ..... 220/266
4,747,498 A 5/1988 Gach
4,807,768 A * 2/1989 Gach ..... 215/216
4,821,899 A * 4/1989 Nycz et al. ..... 215/235
4,848,612 A * 7/1989 Beck ..... 215/235
4,860,907 A * 8/1989 Sondal ..... 215/230
4,892,208 A 1/1990 Sledge
4,913,299 A 4/1990 Petro
4,919,286 A * 4/1990 Agbay, Sr. ..... 215/235
4,934,547 A 6/1990 Mayes et al.
4,940,167 A * 7/1990 Fillmore et al. ..... 222/153.09
5,123,556 A * 6/1992 Goldenberg ..... 215/330
5,163,571 A 11/1992 Morini
5,207,783 A * 5/1993 Burton ..... 215/256
5,215,204 A * 6/1993 Beck et al. ..... 215/252
5,261,569 A * 11/1993 Sandwell ..... 222/205
5,360,127 A 11/1994 Barriac et al.
5,398,829 A * 3/1995 Stubbs ..... 215/256
5,588,546 A 12/1996 Farside
5,605,240 A * 2/1997 Guglielmini ..... 215/256
5,687,866 A * 11/1997 Luch et al. ..... 215/256
5,740,933 A * 4/1998 Conti et al. ..... 215/256
5,785,209 A * 7/1998 Guglielmini ..... 222/153.07
5,992,659 A 11/1999 Nofer et al.
6,481,588 B1 * 11/2002 Wagner ..... 215/235
6,530,493 B2 * 3/2003 Anderson ..... 215/235
6,550,626 B1 4/2003 Randall

* cited by examiner

*Primary Examiner*—Anthony D. Stashick
*Assistant Examiner*—James Smalley
(74) *Attorney, Agent, or Firm*—Chernoff Vilhauer McClung & Stenzel, LLP

(57) ABSTRACT

A fluid-tight vial comprising a locking, flip-top cap and an open-ended cylindrical container is disclosed.

7 Claims, 5 Drawing Sheets

FLUID-TIGHT DILUTION BOTTLE AND CAP

BACKGROUND OF THE INVENTION

The use of buffered and microbiological growth media for microbiological assays is widespread. To obtain accurate assays, it is important that the volume of the fluid be exact to obtain proper dilution of, for example, a bacteria-containing sample, and of paramount importance that its sterility is ensured. It is also important that the concentration of the buffer or growth media components have a predetermined known value. This may be achieved by the preparation of fresh batches of the assay fluids, measuring and/or adjusting the concentration of the components, then using the assay fluids promptly thereafter. The chief drawback of this approach is that it is both time-consuming, labor-intensive and subjects the assay fluid to the possible introduction of sterility-destroying microorganisms.

An alternative, simpler approach has been to use premade sterile microbiological assay fluids that come in specific volumes and concentrations. However, in order to maintain sterility and the proper volume and concentration during storage and shipping, such premade fluids must be contained in fluid-tight containers that prevent the entry of microorganisms and that permit essentially no loss of fluid either through leakage or evaporation. This may be achieved by the use of a container having, for example, a molded breakable seal formed essentially integrally with the container's opening. The drawback of such an approach is that, once the seal is broken, the fluid must be used immediately and any remainder discarded.

The achievement of absolutely fluid-tight reusable containers has been difficult, with even the most fluid-tight containers exhibiting leakage when they are shipped by air, where the lower atmospheric pressure existing at high altitudes, coupled with a lowered vapor pressure of the fluid combine to create a higher relative pressure inside the container, thereby tending to force the liquid out of the container.

There is therefore a need in the art for a fluid-tight container that exhibits essentially no loss of fluid during storage and shipping, including shipment by air, that remains sterile until it is used and that, once opened, may again be sealed to maintain sterility and the predetermined volume and concentration of the assay fluid's components, and which permits retesting of the assay fluid in a simple and convenient manner.

The foregoing need is met by the present invention, which is summarized and described in detail below.

BRIEF SUMMARY OF THE INVENTION

The invention consists of a cylindrical vial and a cap that fits over the opening of the vial, the vial and cap being provided with various features aimed at creating a fluid-tight seal even at the high altitudes encountered during shipment by airplane, and that may be broken by the user when access to the vial's contents is desired and that, once opened, may be resealed to preserve sterility. The top of the vial is provided with a lip, screw threads below the lip and a ratchet-toothed ring below the screw threads, with all three of these features preferably being integrally molded with the top of the vial. The inside of the cap is provided with screw threads to mate with the screw threads of the top of the vial and a ratchet-toothed ring that engages the ratchet teeth of the corresponding ratchet-toothed ring of the top of the vial. In addition, the cap is provided with a frangible peel-away strip that permits a hinged flip-top lid to be freed for opening and closing the vial cap. Finally, the flip-top of the cap is provided with an inner flange that engages the top lip of the vial after removal of the peel-away strip for a secure compression fit, with the flange having a tongue portion in the area of the hinge that guides the flip-top into the correct position for closure.

DETAILED DESCRIPTION OF THE PREFERRED EMBODIMENT

Figure 1:
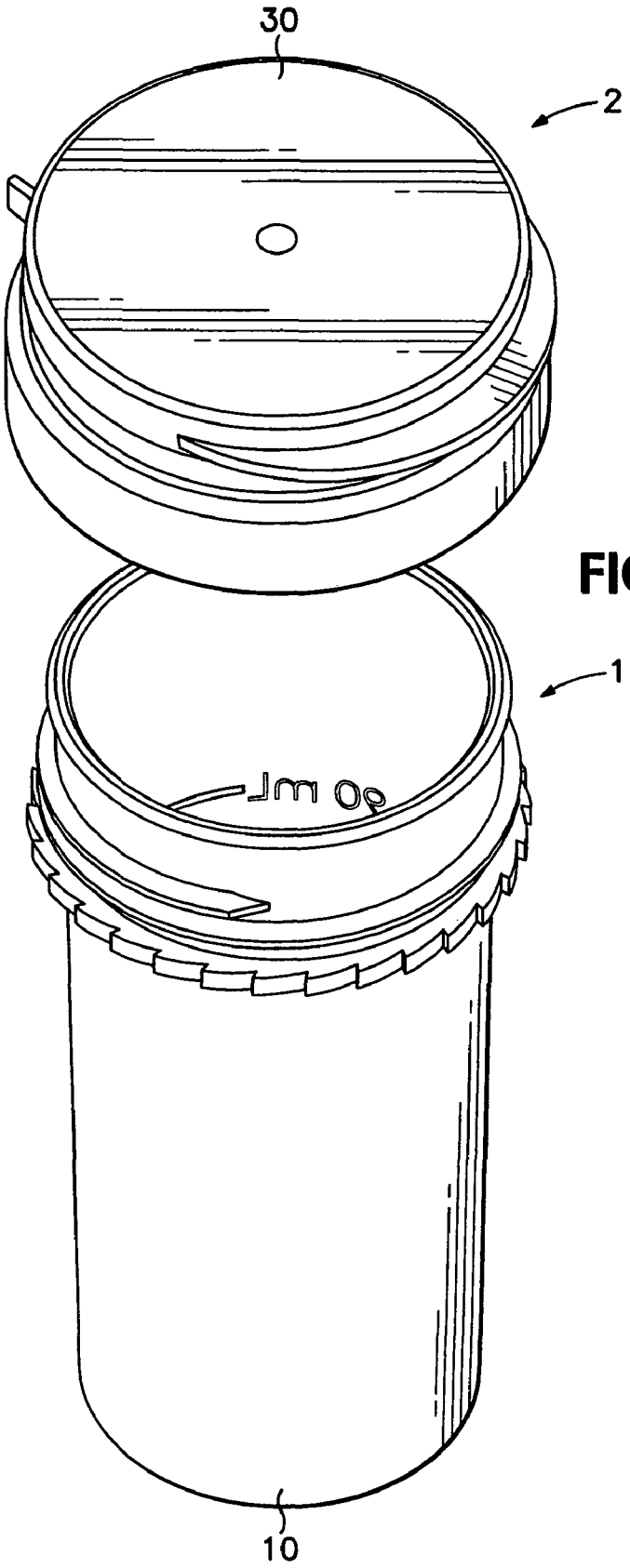
FIG. 1 is an exploded perspective view of the container and cap combination of the invention.
Figure 2:
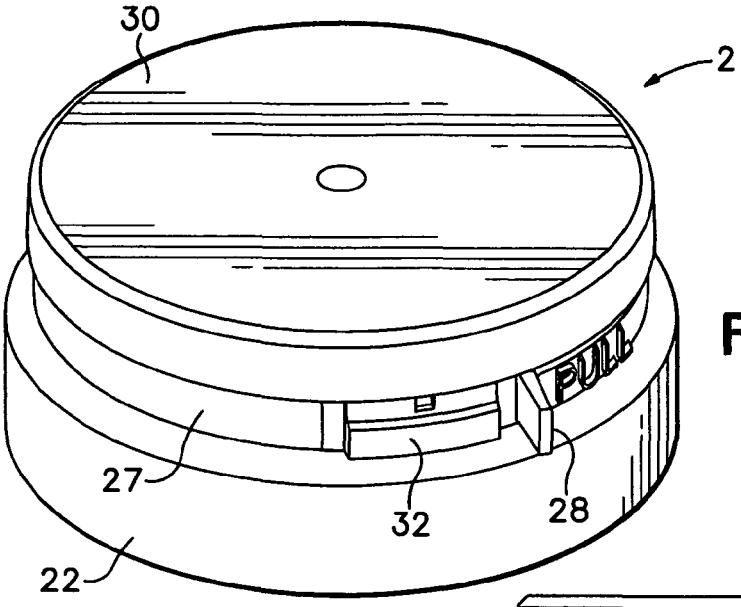
FIG. 2 is a perspective view of the opposite side of the cap portion shown in FIG. 1, featuring a frangible peel-away strip and pull tab.
Figure 3:
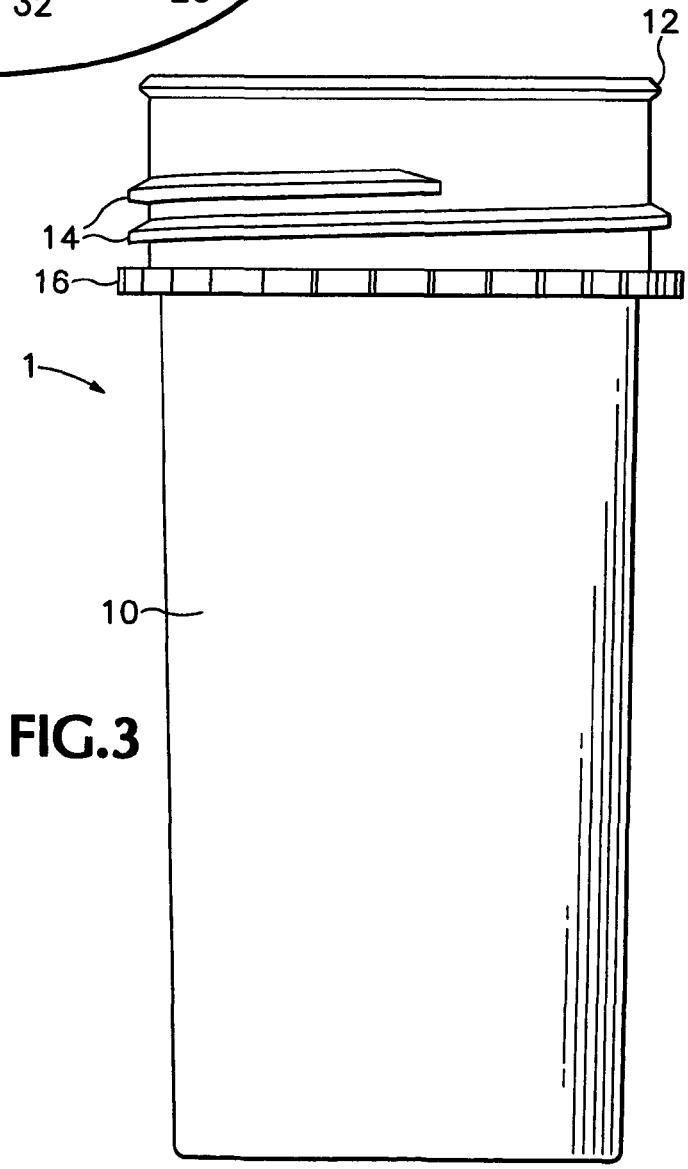
FIG. 3 is a side view of the container portion of the invention.
Figure 4:
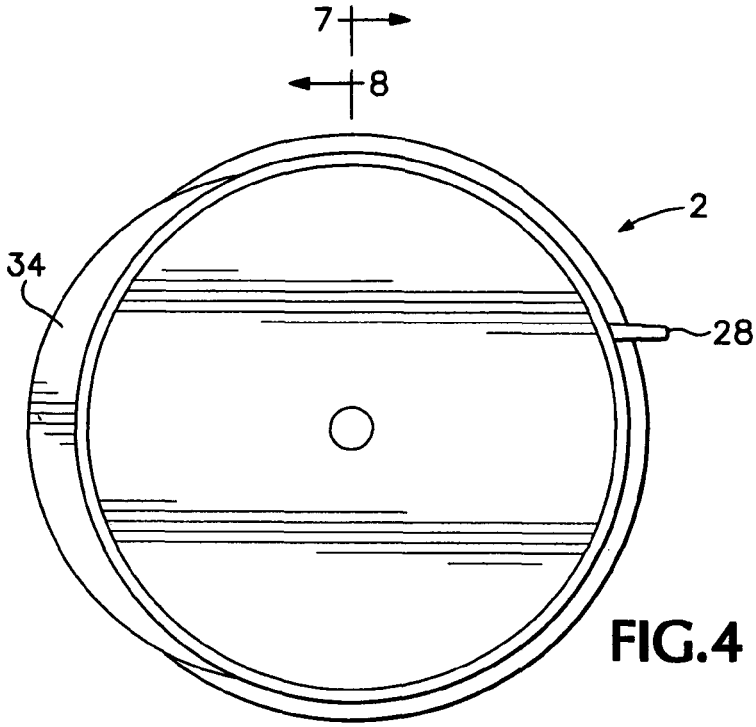
FIG. 4 is a top view of the cap portion of the invention.
Figure 5:
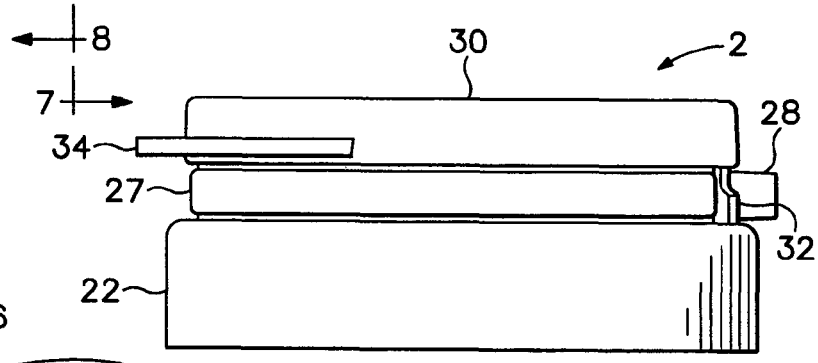
FIG. 5 is a side view of the cap portion of the invention.
Figure 6:
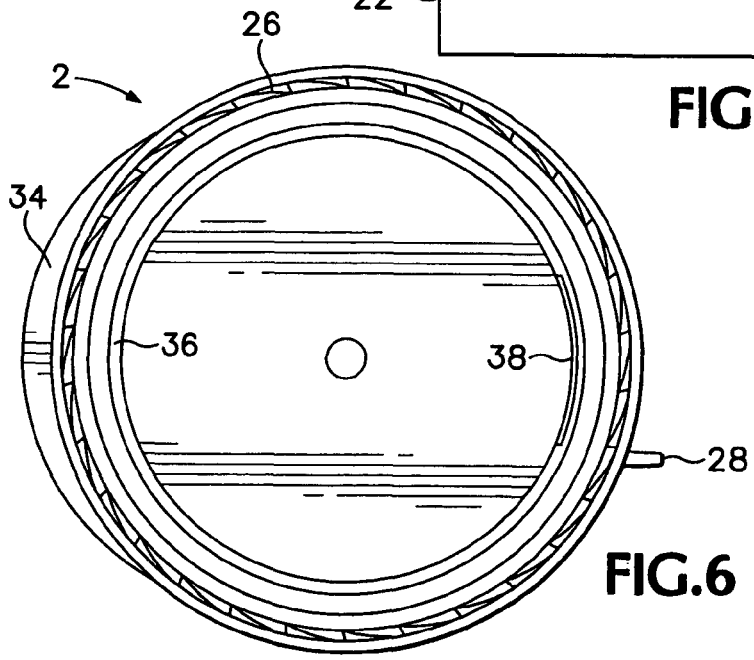
FIG. 6 is a view of the inside of the cap portion of the invention as viewed from the bottom.
Figure 7:
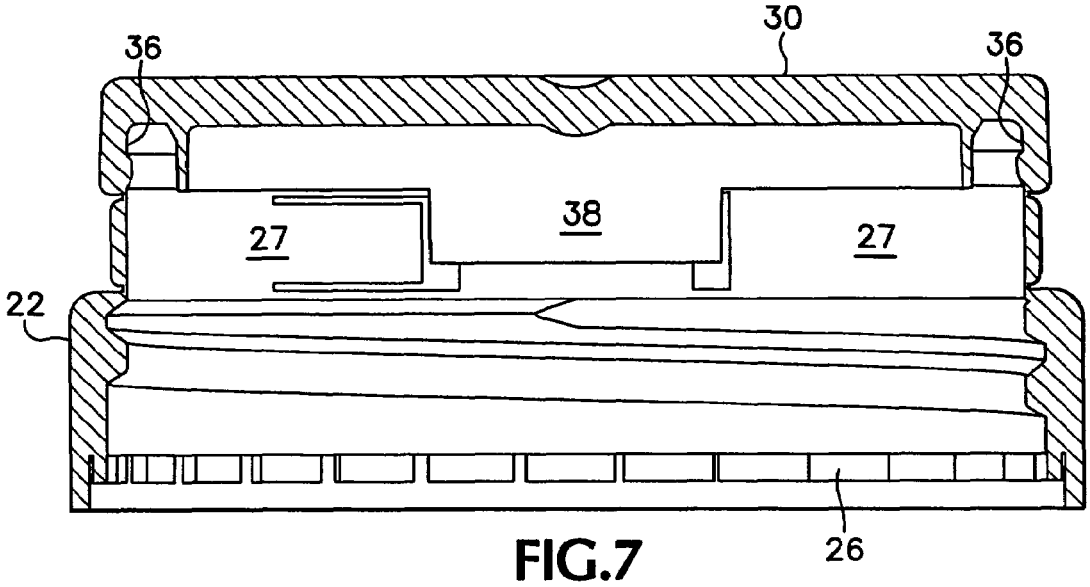
FIG. 7 is a sectional view of the cap shown in FIG. 4 taken along the plane 7—7.
Figure 8:
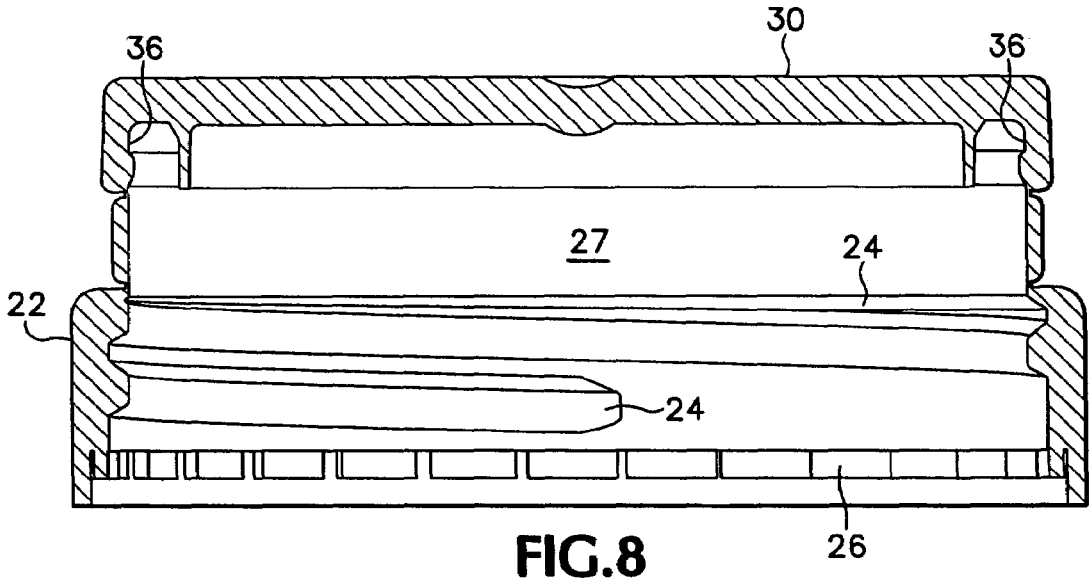
FIG. 8 is a sectional view of the cap shown in FIG. 4 taken along the plane 8—8.
Figure 9:
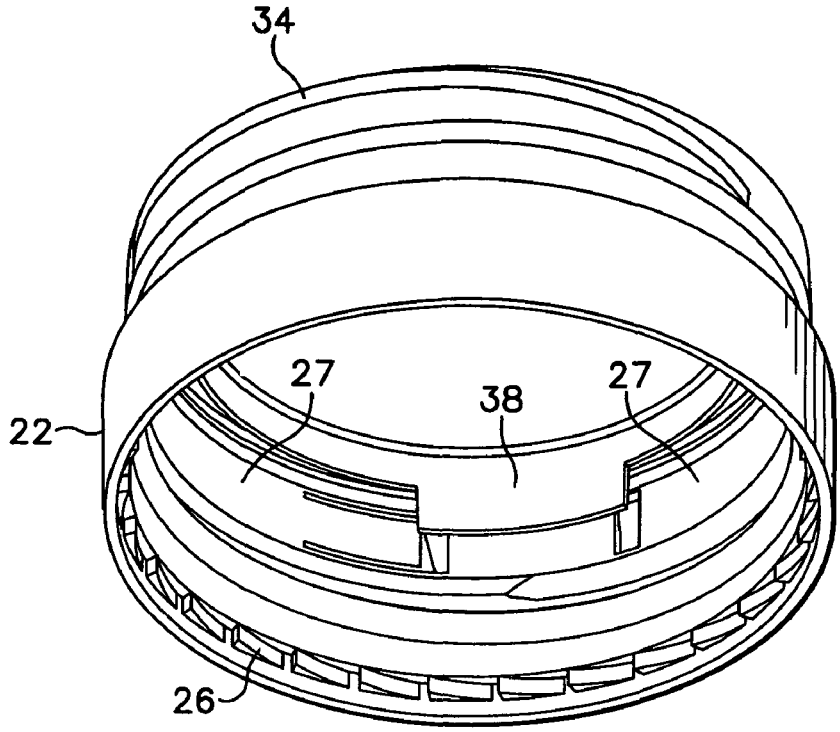
FIG. 9 is a view of the inside of the cap portion of the invention as viewed from one side of the bottom.
Figure 10:
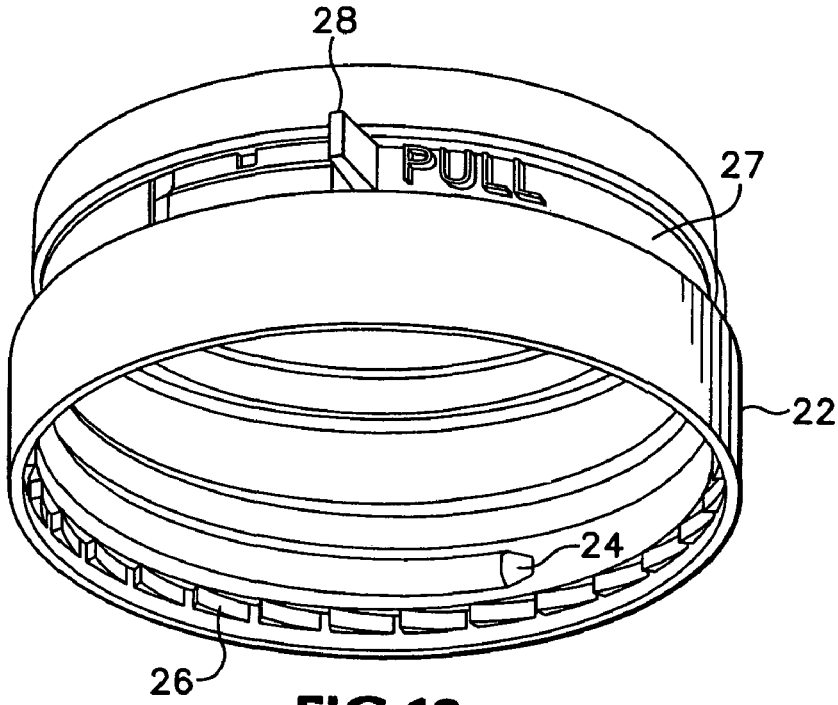
FIG. 10 is a view of the inside of the cap portion of the invention as viewed from another side of the bottom.

Referring to the drawings, wherein like numerals refer to the same elements, there is shown the inventive vial comprising container 1 and cap 2 designed for fluid-tight mating with each other. Container 1 comprises an open-ended substantially cylindrical bottle 10 provided with a lip 12, threads 14 and outwardly projecting ratchet-toothed ring 16, with all three of these features being located proximal to the open end and preferably being integrally molded with the bottle 10.

Both container 1 and cap 2 are preferably molded from polymeric material, more preferably polyethylene and most preferably from recyclable high density polyethylene.

Cap 2 comprises a skirt 22 and flip-top 30 that are integral when frangible stip 27 is in place, but which are in a hinged relationship after the frangible strip 27 is removed by pulling on strip tab 28 to peel away the strip. Flip-top 30 is provided with a flexible hinge 32, pull tab 34, an inner circumferential flange 36 that is adapted to engage lip 12 of the vial after the frangible strip is removed, with flange 36 having a tongue portion 38 that guides flip-top 30 into place so that flange 36 is properly aligned with lip 12.

Skirt 22 is provided on its inner wall with screw threads 24 adapted to engage corresponding screw threads 14 of bottle 10, and with an inwardly projecting ratchet-toothed ring 26 adapted to engage the corresponding outwardly projecting ratchet-toothed ring 16 of bottle 10.

In a typical application the vial is filled with 90 or 99 mL of either an aqueous buffered solution or an aqueous microbiological growth medium comprising, for example, a peptone at a certain concentration. The cap is threaded onto the vial and compressed while twisting so that the corresponding ratchet-toothed rings engage and permanently lock the cap to the vial by a compression fit that is fluid-tight. When ready for use in conducting a microbiological assay to assess the degree of sterility in an environment, the peel-away strip is removed, a 1 mL or 10 mL sample containing, for example, suspected bacteria is injected into the fluid-containing vial to dilute the sample to 1 or 10 vol %, the flip-top is snapped close, the mixture is agitated to ensure thorough mixing, and the so-diluted sample is allowed to incubate for an appropriate time period. Following incubation, samples of the contents of the dilution vial are deposited on solid growth media in, for example, petri dishes, and colony counts are conducted to identify the nature and degree of bacterial contamination. The remaining contents of the vial may be preserved in a sterile condition for possible later assays to specifically identify a possible pathogen by simply closing the vial's flip-top and storing the vial in an appropriately refrigerated environment.

Leakage testing of fluid-filled vials of the invention was conducted both by actual air transport at commonly encountered commercial air shipment altitudes of up to 10,000 feet and in a vacuum chamber under reduced pressure to simulate the environment encountered in the cargo hold of an airplane at altitudes of up to 12,000 feet. There was no loss of fluid with either type of test.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

The invention claimed is:

1. A fluid-tight vial comprising:

(a) a substantially cylindrical container with an open end having a circumferential lip, a circumferential flange integral with said circumferential lip, a screw thread and a ratchet-toothed ring proximal to said open end; and (b) a cap adapted to engage said container's open end in fluid-tight fashion, said cap comprising a circumferential skirt, a hinge, a frangible strip and a flip-top, wherein the inner portion of said skirt has a screw thread capable of matingly engaging said screw thread of said open end of said container and a ratchet-toothed ring capable of lockingly engaging said ratchet-toothed ring of said open end of said container when said cap is threaded onto said container wherein said flip-top has an inner circumferential recess capable of non-threadedly engaging said circumferential flange to form a fluid-tight seal between said flange and said recess.

2. The vial of claim 1 wherein said screw thread of said container is located below said circumferential lip and said ratchet-toothed ring of said container is located beneath said screw thread of said container.

3. The vial of claim 2 wherein said ratchet-toothed ring of said cap is located beneath said screw thread of said cap.

4. The vial of claim 1 wherein said frangible strip is located between said skirt and said flip-top.

5. The vial of claim 4 wherein said frangible strip has a pull tab for peeling it away from said cap.

6. The vial of claim 5 wherein said flip-top is attached to said skirt by said hinge and is openable after said frangible strip is removed.

7. The vial of claim 1 wherein said inner circumferential recess of said flip-top has a radial tongue portion proximal to said hinge capable of guiding said inner circumferential recess into alignment with said circumferential flange-of said container.

* * * * *